US005785123A

United States Patent [19]

Lea, Jr.

[11] Patent Number: 5,785,123

[45] Date of Patent: Jul. 28, 1998

[54] APPARATUS AND METHOD FOR CONTROLLING A WELL PLUNGER SYSTEM

[75] Inventor: James F. Lea, Jr., Tulsa, Okla.

[73] Assignee: Amoco Corp., Chicago, Ill.

[21] Appl. No.: 665,671

[22] Filed: Jun. 20, 1996

[51] Int. Cl.[6] ..... E21B 43/12

[52] U.S. Cl. ..... 166/369; 137/624.15; 166/53

[58] Field of Search ..... 166/53, 369–372; 137/624.15, 624.2

[56] References Cited

U.S. PATENT DOCUMENTS

| | | | |
|---|---|---|---|
| 4,150,721 | 4/1979 | Norwood | 166/53 |
| 4,215,746 | 8/1980 | Hallden et al. | 166/53 |
| 4,275,790 | 6/1981 | Abercrombie | 166/53 |
| 4,596,516 | 6/1986 | Scott et al. | 417/58 |
| 4,664,602 | 5/1987 | Gordon | 417/56 |
| 4,685,522 | 8/1987 | Dixon et al. | 166/372 |
| 4,921,048 | 5/1990 | Crow et al. | 166/372 |
| 4,923,372 | 5/1990 | Ferguson et al. | 417/53 |
| 4,989,671 | 2/1991 | Lamp | 166/53 |
| 5,132,904 | 7/1992 | Lamp | 166/53 X |
| 5,146,991 | 9/1992 | Rogers, Jr. | 166/369 |
| 5,253,713 | 10/1993 | Gregg et al. | 166/372 |

OTHER PUBLICATIONS

"What's New in Artificial Lift", James F. Lea and Herald W. Winkler, World Oil/Apr. 1994, pp. 107–114.

"Plunger-Lift Performance Criteria With Operating Experience–Ventura Avenue Field" D. L. Foss and R. B. Gaul, Shell Oil Company, Presented at the Spring Meeting, May 1965, pp. 125–140.

*Primary Examiner*—Hoang C. Dang
*Attorney, Agent, or Firm*—Arnold, White & Durkee

[57] ABSTRACT

An apparatus and method for controlling a well plunger system for the production of natural gas is described. The well plunger system includes a plunger tube positioned within a casing of a gas well, a tubing line connected to the plunger tube, a plunger moveable within the plunger tube, a plunger sensor for detecting the presence of the plunger, a valve connected to the tubing line and to the general gas distribution system including a sales line and a gas flow meter, a pressure sensor connected to the sales line, a motor for operating the valve, and a pressure sensor connected to the casing. The controller calculates the duration of an open interval when the valve is opened and a closed interval when the valve is closed based on a calculated average plunger velocity of the plunger after the valve is opened. The controller compensates for changes in sales line pressure by adjusting the calculated average plunger velocity by an amount equivalent to the changes in sales line pressure. After the calculated average plunger velocity is adjusted it is compared against a low velocity minimum and a high velocity maximum that define a desired operating range. If the calculated average plunger velocity falls outside of the desired operating range the controller increments or decrements the close interval by a fixed amount of time, compensating for changes in sales line pressure.

10 Claims, 4 Drawing Sheets

APPARATUS AND METHOD FOR CONTROLLING A WELL PLUNGER SYSTEM

FIELD OF THE INVENTION

This invention relates generally to an apparatus and method for the control of well plunger systems, more specifically, the control of well plunger lifts in natural gas and oil wells.

BACKGROUND OF THE INVENTION

In a well plunger system of a type utilizing the present invention, the primary focus is on the production of natural gas ("gas"), but the invention is also applicable to well plunger systems where the primary focus is on oil production. Accordingly, the invention is described in association with a well plunger system producing natural gas but the scope of the invention is not limited to such a system. To begin gas production, a well is bored into the earth to facilitate the removal of gas. In many gas wells the relatively low rate of gas flowing into the well is insufficient to expel oil and water that introduced into the well during gas production. These liquids must be removed from the well, otherwise gas production will effectively cease Plunger systems powered by the force of the gas pressure itself have been used in an attempt to address this problem.

In a typical well plunger system, the well is sealed off from the outside world with a valve and a cylindrical casing in the well. A sales line connects the valve to the remainder of the gas distribution system and a sales meter is connected to the sales line for measuring amount of gas that has passed through the sales line. Gas and liquids enter near the bottom of the casing to the interior of the casing. Closing the valve has the effect of allowing pressure inside the casing to increase. A tubing line extends from the valve to a plunger tube which extends to near the bottom of the casing. A plunger is positioned at or near the bottom of the plunger tube. A controller determines when to open the valve. After the valve is opened, the plunger is forced upward inside the plunger tube due to the built up pressure inside the casing and continued well production of gas of liquids. A plunger sensor at the top of the plunger tube detects the presence of the plunger when it arrives at the top of the plunger tube and informs the controller. The controller calculates the "calculated average plunger velocity" of the plunger after it travels from the bottom to the top of the plunger tube. The "calculated average plunger velocity" is the average velocity of the plunger as it rises inside the plunger tube between the time the valve is opened until the time the plunger arrives at the top of the plunger tube and is detected by the plunger sensor. The controller compares the calculated average plunger velocity against a desirable range of average plunger velocities to determine whether the calculated average plunger velocity is either above the range, below the range or in the range. If the calculated average plunger velocity is in the desirable range of average plunger velocities, then the controller will not vary the open and close times of the valve. If the calculated average plunger velocity is higher than the desired range of average plunger velocities then the controller will either decrease the amount of time the valve is closed or increase the amount of time the valve is opened or both. If the calculated average plunger velocity is lower than the desired range of average plunger velocities then the controller will either increase the amount of time the valve is closed or decrease the amount of time the valve is opened or both.

Ideally, controlling the valve in this manner allows the gas, as well as any oil and water, to be forced up the plunger tube inside the casing by the plunger. As long as the valve is open, more gas, and typically oil and water, flow into the plunger tubing below the plunger. Once the plunger reaches the top of the plunger tube, gas flows through or past the plunger into a tubing line. After the valve has been open for an amount of time determined by the controller, the controller causes the valve to be closed and the plunger falls back down the plunger tubing to a resting position at or near the bottom of the tube.

In a known well plunger system of the type described, various problems with the production of natural gas exist. If the controller operates the valve based on calculated average plunger velocity alone, as described above, for many wells the valve is either opened too early or too late in the cycle to optimize gas production for reasons discussed below. If the valve is opened too early, the pressure in the casing is insufficient to force the plunger to completely lift the water and oil out of the well. If the plunger fails to lift water and oil out of the well for too many cycles of opening and closing the valve, this results in the well becoming filled ("logged") with water and oil and shut down ("logged off"). In this case, gas production continues to decrease until it ceases, causing an interruption in gas production and a corresponding loss of revenues derived from that well. It is desirable to prevent the logging off of wells.

In the situation where the valve is opened too late, excessive pressures can build up behind the plunger, forcefully impacting the plunger against the top of the casing and potentially causing damage. Even if no damage is done, waiting too long between opening the valve after each cycle means less gas is produced from the well, again resulting in a corresponding loss of revenues derived from that well.

Accordingly, it is desirable to optimize the amount of time that is allowed to pass between intervals of opening and closing the valve to maximize the production of natural gas.

SUMMARY OF THE INVENTION

The problems described above are overcome by an apparatus and method for controlling a well plunger system. The present invention optimizes plunger control by adjusting the calculated average plunger velocity to a value different than the measured average velocity in order to compensate for variations in sales line pressure. The calculated average plunger velocity is used by the controller to determine the duration of the upcoming intervals for opening and closing the valve controlling the well. Variations in sales line pressure after upcoming intervals for opening and closing the valve are already calculated should be compensated for by the controller because these variations are an important source of inaccuracy in controlling the well.

In the preferred embodiment, the well plunger system uses a well plunger system such as that described in U.S. Pat. No. 5,146,991 (Ser. No. 684,162), hereby incorporated by reference. The well plunger system includes a plunger tube positioned within the casing of a gas well, a tubing line connected to the plunger tube, a plunger moveable within the plunger tube, a plunger sensor for detecting the presence of the plunger proximate to the top of the plunger tube, a tubing line connecting the plunger line to a valve, the valve connected to the general gas distribution system including a sales line and a gas flow meter, and a controller for operating the valve through a motor. The well plunger system is described for use with a well whose primary purpose is the production of gas. However, it is within the scope of the present invention for the well plunger system to also be used in wells whose primary purpose is the production of oil.

The controller operates the well by opening and closing the valve which regulates gas production and fluid elimination with the plunger. A plunger cycle is one interval when the valve is opened followed by one interval when the valve is closed. The controller specifies the amount of time the valve is opened and closed based on the calculated average plunger velocity as described in U.S. Pat. No. 5,146,991 (Ser. No. 684,162), incorporated by reference.

The actual average plunger velocity of the plunger is a function of the pressure difference between the casing pressure in the well, below the plunger, and the sales line pressure, above the plunger. The greater the pressure difference between the casing and the sales line the greater the actual average plunger velocity, likewise, the lower the pressure difference between the casing and the sales line the lower the actual average plunger velocity. The controller calculates the calculated average plunger velocity by dividing the known length of the plunger tube by the amount of time elapsed between the point at which the valve was opened by the controller and the point at which the plunger was detected at the top of the plunger tube by the plunger sensor.

In order to properly control the well, it is desirable to keep the calculated average plunger velocity of the plunger within a specific range of values. Unfortunately, after the calculated average plunger velocity and the corresponding intervals for opening and closing the valve have been calculated, gas pressure in the sales line often varies significantly, making the calculated intervals for opening and closing the valve incorrect. The present invention ameliorates the inaccuracies in the calculated intervals for opening and closing the valve by adjusting the calculated average plunger velocity by an amount calculated to compensate for the change in sales line pressure. The controller uses an equation to convert a change in sales line pressure to a corresponding change in calculated average plunger velocity.

The present invention adds a sales line pressure sensor to the sales line for measuring pressure changes of gas. Electrical signals from the sales line pressure sensor indicating sales line pressure are transmitted to the controller where the sales line pressure is converted into an equivalent change in calculated average plunger velocity. The controller adjusts the calculated average plunger velocity up or down depending on the change in sales line pressure to compensate for changes in sales line pressure. A casing pressure sensor is also added to the well plunger system for sensing casing pressure. The casing pressure sensor transmits electrical signals corresponding to casing pressure to the controller which uses casing pressure as part of an equation to calculate the quantity of fluid filling the well each plunger cycle. The quantity of fluid filling the well each plunger cycle is used by the controller to solve the equation used to adjust the calculated average plunger velocity.

At the end of each cycle, the controller records the pressure in the sales line just prior to opening the valve. After the valve is opened, the plunger will rise to the top of the plunger tube where it is detected by the plunger sensor and the controller calculates the calculated average plunger velocity. Based on the calculated average plunger velocity, the controller calculates the length of the time interval for keeping the valve open ("open interval") and the length of the time interval for keeping the valve closed ("closed interval").

After current open interval, the controller closes the valve and the plunger begins descending the plunger tube. In the present invention, the controller continually calculates how much to adjust the measured average plunger speed based on the difference in sales line pressure recorded just prior to when the valve was opened and the sales line pressure after the valve is closed until the controller opens the valve again. The controller continually monitors the sales line pressure while the valve is closed.

If the sales line pressure has decreased since the last time the valve was opened, that decrease in sales line pressure is used to increase the calculated average plunger velocity by a corresponding amount, as calculated by the equation described below. If the calculated average plunger velocity now exceeds a high velocity maximum, then the controller will correspondingly subtract an increment of time from the close interval. Subtracting the increment of time from the close interval decreases the amount of time for pressure to build up in the casing, thus the casing pressure will be lower when the valve is opened. Having a lower casing pressure when the valve is opened compensates for the lower sales line pressure occurring in the sales line because the pressure difference between the casing pressure and the sales line pressure that causes the plunger to rise is approximately the same as when the close interval was previously selected.

If the sales line pressure has increased since the last time the valve was opened, that increase in sales line pressure is used to decrease the calculated average plunger velocity by a corresponding amount, as calculated by the equation described below. If the calculated average plunger velocity now exceeds a low velocity minimum, then the controller will correspondingly add an increment of time to the close interval. Adding the increment of time to the close interval increases the amount of time for pressure to build up in the casing, thus the casing pressure will be higher when the valve is opened. Having a higher casing pressure compensates for the higher sales line pressure occurring in the sales line.

The controller continually adjusts the measured average plunger speed when the valve is closed until the controller determines that enough time has past for sufficient pressure to build up in the casing to propel the plunger upwards inside the plunger tube at an average velocity within a selected operating range. The selected operating range is the range of measured average plunger velocities between the high velocity maximum and the low velocity minimum. Although the controller continually adjusts the measured average plunger speed when the valve is closed, the controller changes the close interval only when the calculated average plunger velocity (as adjusted) exceeds either the high velocity maximum or the low velocity minimum.

The present invention also contains a high velocity limit above the high velocity maximum and a low velocity limit below the low velocity minimum. If the calculated average plunger velocity (as adjusted) rises above the high velocity limit or the falls below the low velocity limit the controller will not allow the valve to be opened until conditions change or an operator intervenes.

Figure 1:
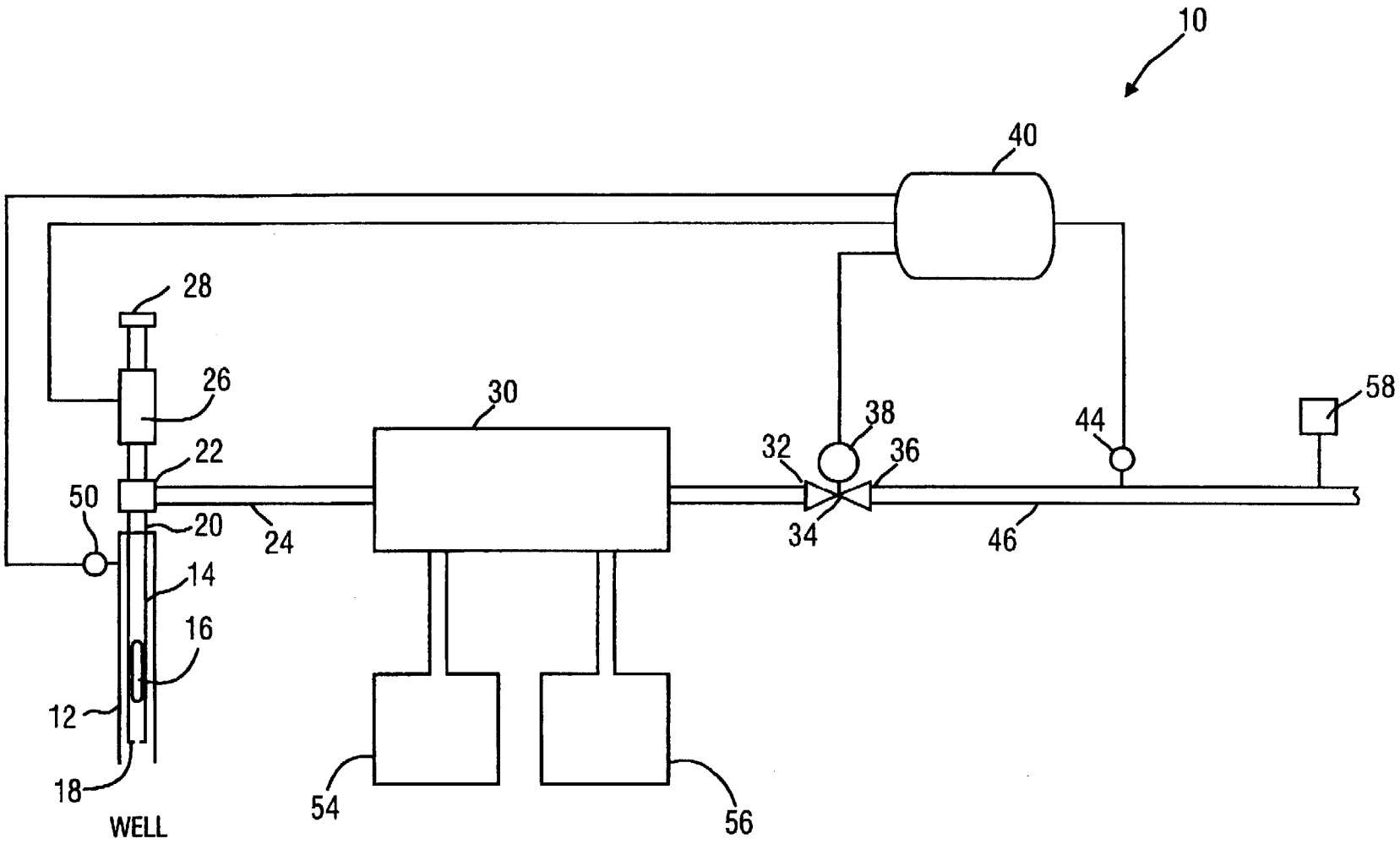
FIG. 1 is a block diagram of the apparatus for a method for controlling a well plunger system embodying the present invention.

While the invention is susceptible to various modifications and alternative forms, specific embodiments thereof are shown by way of example in the drawings and are described in detail. It should be understood, however, that the drawings and description are not intended to limit the invention to the particular forms disclosed. On the contrary, the intention is to cover all modifications, equivalents, and alternatives falling with in the spirit and scope of the invention as defined by the appended claims.

DETAILED DESCRIPTION OF THE INVENTION

Turning now to the drawings and referring to FIG. 1, a well plunger system 10 positioned in a casing 12 in a well and connected to a gas line distribution system is illustrated. The well casing 12 is hollow and is open at its bottom end to allow gas, oil and water (typically present in varying quantities) to flow into the casing 12. Inside the casing, 12 is a plunger tube 14. The plunger tube 14 contains a plunger 16 capable of moving lengthwise up and down within the plunger tube 14. The plunger 16 is moveable by pressure and gravity. At the bottom of the plunger tube 14, plunger 16 movement is restricted by a stop 18.

The casing, 12 is sealed to the plunger tube 14 at the top 20 of the casing 12. The plunger tube 14 passes through a junction box 22 where it is connected to a tubing line 24. Above the junction box 22 the plunger tube 14 passes through a plunger sensor 26 and ends just above the plunger sensor 26 at an upper stop 28. The upper stop 28 includes a coiled spring (not shown) positioned at the top and inside the plunger tube 14 to help stop the plunger. The plunger sensor 26 detects the presence or absence of the plunger 16 proximate to the top of the plunger tube 14, above the casing 12, and produces a corresponding electrical signal.

From the junction box 22, the tubing line 24 passes through a production unit 30 and terminates at an inlet portion 32 of a valve 34 which also has an outlet portion 36. The production unit 30 is well known in the field and separates gas from oil and water. Opening, and closing of the valve 34 is electromechanically controlled by a motor 38. While an electromechanical valve and motor are illustrated, any type of valve and associated control can be used. The motor 38 is operated by a controller 40. In the present invention, any controller which can receive the various inputs, perform the calculations and provide an output to control a valve based on calculated average plunger velocity as described herein can be used. As described in U.S. Pat. No. 5,146,991, the controller 40 operates the valve 34 based on the calculated average plunger velocity of the plunger 16. The controller 40 calculates the average velocity of the plunger 16 by dividing the known length of the plunger tube 14 by the amount of time elapsed between the time when the controller 40 caused the valve 34 to be opened and the time when the plunger sensor 26 reported the arrival of the plunger 16 at the upper stop 28 at the top of the plunger tube 14.

In the preferred embodiment, the controller 40 receives electrical signals from the plunger sensor 26 as well as from a sales line pressure sensor 44 and a casing pressure sensor 50. The sales line pressure sensor 44 is connected to a sales line 46, the casing pressure sensor is connected to the casing 12. The electrical signals from sensors 42 and 50 are indicative of the pressure of gas at different points in the well plunger system 10 where those sensors 42,50 are attached.

During the close interval of a typical well cycle, the controller 40 periodically samples the pressure in the sales tubing 46. Approximately at the time the controller 40 opens the valve 34, the controller 40 samples the sales line pressure with the pressure sensor 44 and stores the sales line pressure measurement in its memory as indicative of the sales line pressure when the valve 34 was opened. After the plunger sensor 26 reports the plunger 16 has arrived at the upper stop 28 at the top of the plunger tube 28, the controller 40 calculates the calculated average plunger velocity as described above. The open interval and the close interval are calculated by the controller 40 based on the calculated average plunger velocity, described in U.S. Pat. No. 5,146,991. After the amount of time allotted for the current open interval has past, the controller 40 closes the valve 34. Once the valve 34 is closed, the plunger 16 will begin to descend inside the plunger tube 14 under the force of gravity. Waiting at least a minimum amount of time after the valve 34 is closed before reopening the valve 34 allows the plunger 16 to drop to the stop 18 at the bottom of the plunger tube 14. The minimum amount of time is calculated based on the type of plunger 16 used and the depth of the well as is well known to those of ordinary skill in this field. After the close interval has ended, the controller 40 causes the valve 34 to open. Just prior to the opening of the valve 34 the pressure in the casing 12, plunger tubing 14 and tubing line 24 are significantly higher than the pressure in the sales line 46. Once the valve 34 is opened, gas in the tubing line 24 and plunger tubing 14 will rapidly expand through the valve 34 into the sales line 46. This causes the pressure above the plunger 16 to decrease. The plunger 16, which was resting on the bottom of the plunger tube 14 when the controller 40 opened the valve 34, begins to rise inside the plunger tube 14 because the pressure below the plunger 16 is greater than the pressure above it. As the plunger 16 rises it remains relatively sealed against the walls of the plunger tube 14 such that the plunger 16 lifts the slug of water and oil above it, along with the gas, through the plunger tube 14. The slug and the gas are forced up through the junction box 22 into the tubing line 24 as is well known in the field. The plunger 16 moves through the junction box 22, allowing the remaining gas and perhaps some oil and water to continue flowing through the tubing line 24. The gas, oil and water flow through the tubing line 24 to the production unit 30 where the oil is separated and transferred to an oil tank 54 and the water is separated and transferred to a water tank 56 as is well known in the field. The gas passes through the production unit 30 to the valve 34 and into the sales line 46 where it is eventually delivered to customers. The amount of gas produced is measured and recorded by a sales meter 58 attached to the sales line 46.

The controller 40 determines when to close the valve 34 in the manner described in U.S. Pat. No. 5,146,991. When the valve 34 is closed, the pressure above and below the plunger 16 becomes approximately the same, so the force of gravity becomes the dominant force on the plunger 16. Gravity pulls the plunger 16 back down inside the plunger tube 14 until the plunger 16 comes to rest on the bottom of the plunger tube 14. The plunger 16 is designed to let fluid pass through or around the plunger 16 as it descends the plunger tube 14 as is well known in the field.

Figure 2A:
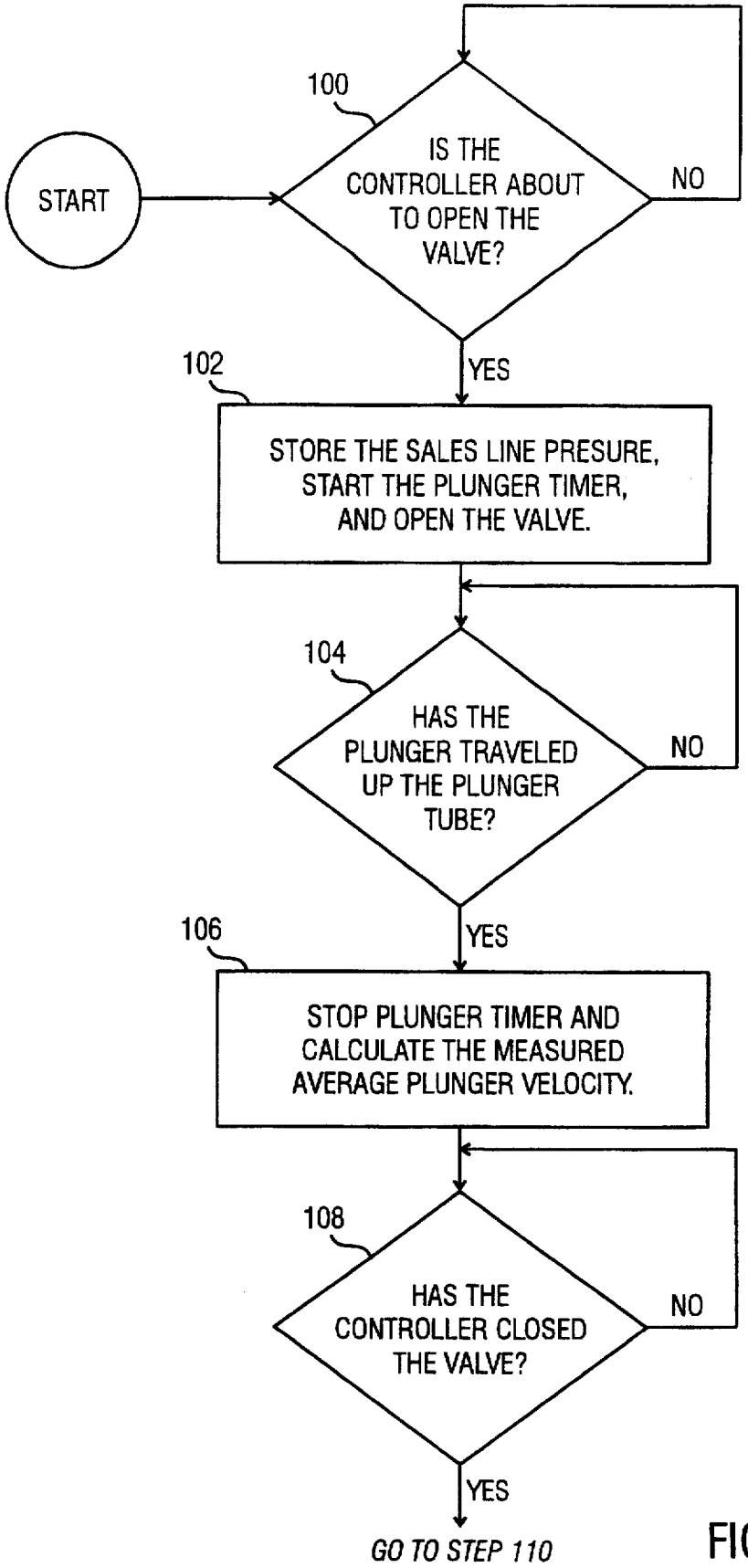
FIG. 2A is flow chart of a portion of the method for controlling a well plunger system embodying the present invention illustrating some of the initial steps taken by a controller according to the present invention.
Figure 2B:
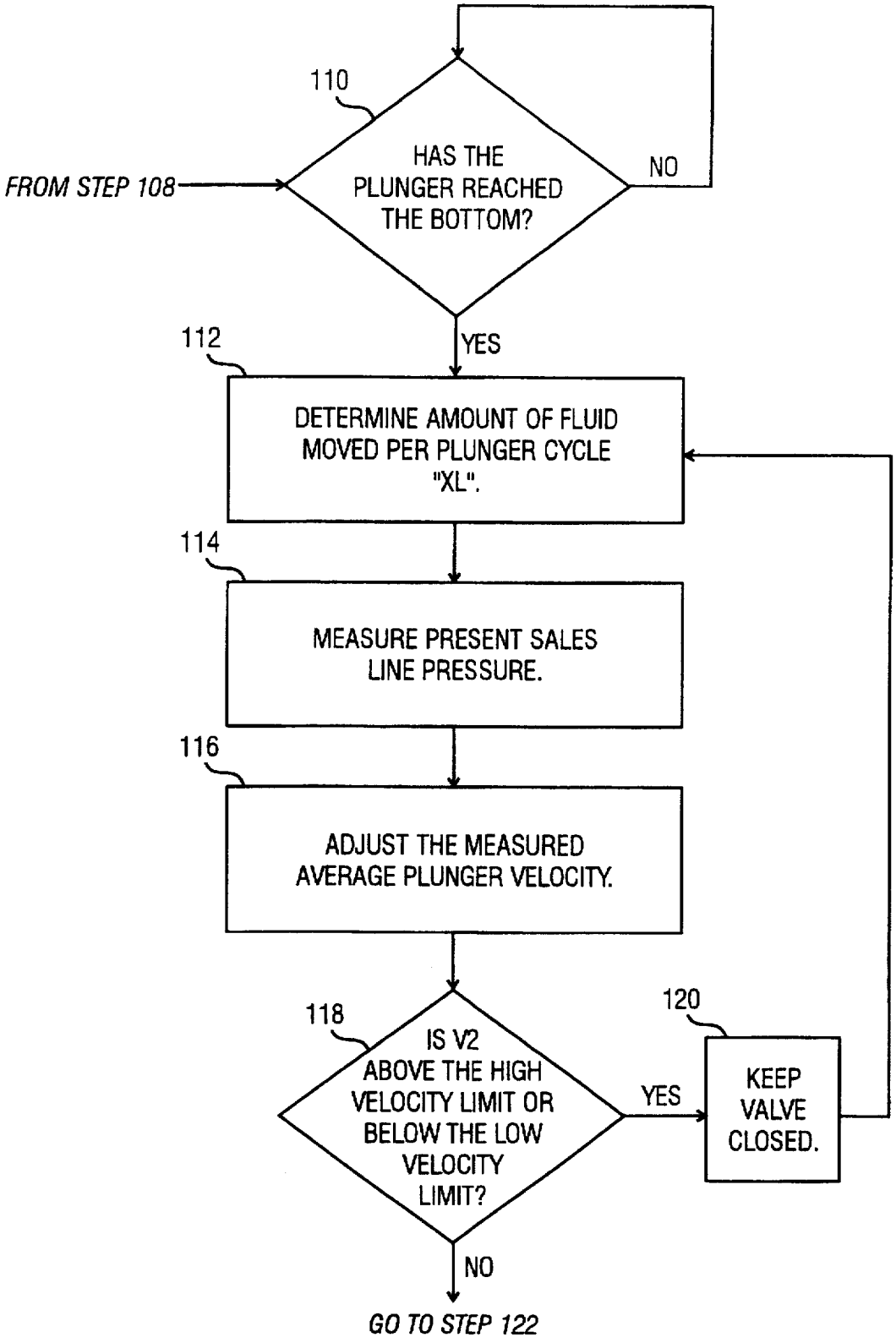
FIG. 2B is flow chart of a portion of the method for controlling a well plunger system embodying the present invention illustrating some of the steps taken by controller to adjust the calculated average plunger velocity according to the present invention.

As illustrated in FIG. 2A, the controller 40 performs a series of steps to optimize production in the well by adjusting the measured average plunger speed used by the controller 40 to determine the proper timing for opening and closing the valve 34. In FIG. 2A, step 100, the controller 40 determines if the controller 40 is about to open the valve 34, as described in U.S. Pat. No. 5,146,991 (Ser. No. 684,162), incorporated by reference. In step 100, if the controller 40 is not about to open the valve, continue periodically executing step 100, otherwise, proceed to step 102. In step 102, the controller 40 stores the sales line pressure as indicated by the sales pressure sensor and the controller 40 starts a plunger timer in the controller 40, then the controller opens the valve 34 and proceeds to step 104. In step 104 the controller 40 determines if the plunger 16 has traveled to the stop 28 at the top of the plunger tube 14 as indicated by the plunger sensor 26, if not, continue periodically performing step 104, if so, continue to step 106. In step 106, the controller 40 stops the plunger timer, thus indicating the travel time of the plunger 16 up the plunger tube, and the controller 40 uses the travel time to calculate the calculated average plunger velocity. From step 106 the controller 40 proceeds to step 108. At step 108, if the controller has closed the valve, as described in U.S. Pat. No. 5,146,991 (Ser. No. 684,162), incorporated by reference, then continue to step 110, otherwise, continue periodically performing step 108. At step 110, in FIG. 2B, the controller 40 determines whether the plunger 16 has reached the stop 18 at the bottom of the plunger tube 14 by waiting until an amount of time sufficient for the plunger 16 to fall to the stop 18 at the bottom of the plunger tube 14 as entered by the operator. In step 110, if the plunger 16 has reached the bottom of the plunger tube 14, proceed to step 112, otherwise, continue periodically performing step 110.

At step 112, the controller 40 determines the amount of fluid moved by the plunger 16 per plunger cycle, "XL". In the preferred embodiment, XL is determined by solving the following equation for XL:

$$Pmin=(Pp+Pt+(Plh+Plf)\cdot XL)\cdot(1+Depth/K).$$

Pmin equals the casing pressure when the plunger 16 reaches the bottom of the plunger tube 14. The casing pressure is transmitted to the controller 40 from the casing pressure sensor 50. Pp equals the pressure necessary to lift the plunger alone, typically about 5 pounds per square inch ("psi"). Pp and all factors of the equations herein are entered by an operator, unless otherwise indicated. Factors that are constants are well known in the field. Pt1 equals the sales line pressure when the valve was opened, which the controller 40 stored in step 102. Pt1 is used for Pt for determining XL. Plh is the pressure that will support the weight of the slug of fluids above the plunger when the valve was opened. Plh is equal to the specific gravity of the fluid in the slug multiplied by (0.433) multiplied by the length of one barrel of the slug in the plunger tubing 14. A barrel is approximately 5.615 cubic feet. Plf is the pressure to balance the effects of liquid slug friction and is equal to:

$$SPG\cdot 0.433\cdot Fl\cdot L\cdot V^2/(D/12\cdot 2\cdot 32.2)$$

SPG is equal to the specific gravity of the fluid in the slug. Fl is equal to the liquid friction factor and is well known in the field. L is equal to the length of one barrel of the slug in the plunger tubing 14. $V^2$ is equal to calculated average plunger velocity squared. D is the internal diameter of the plunger tubing 14. "Depth", as used in the equation for Pmin is equal to the depth of the well. K is defined by the following equation:

$$1/K=Fg\cdot V^2\cdot Gg/(D/12\cdot 2\cdot 32.2\cdot(T+460)\cdot Z\cdot R)$$

Fg is the friction factor of the gas flowing in the plunger tubing 14. Gg is equal to the specific gravity of the gas. T is equal to the average temperature of the gas throughout the casing in degrees Fahrenheit. Z is equal to the gas compressibility factor. R is equal to the gas constant.

In the preferred embodiment, at step 112, XL is calculated as described above, however, in an alternative embodiment, the operator enters a value for XL. After the controller 40 completes step 1 12, the controller 40 proceeds to step 114.

At step 114, the controller 40 measures the present sales line pressure ("Pt2") with the sales line pressure sensor 44, and the controller 40 proceeds to step 116. Pt2 is measured when the valve 34 is closed, i.e., during the close interval. In step 116, the controller 40 calculates the calculated average plunger velocity (adjusted) ("V2") by solving the following equation for V2:

$$(Pp+Pt+(Plh+Plf)\cdot XL)\cdot(1+Depth/K)=(Pp+Pt+(Plh+Plf)\cdot XL)\cdot(1+Dp/K)$$

In the left half of the equation, the calculated average plunger velocity calculated by the controller 40 in step 106 ("VI") is used for V and Pt1 is used for the pressure in the sales line ("Pt"). In the right half of the equation, V2 is used for V and Pt2 is used for the pressure in the sales line ("Pt"). V enters into the equation as part of Plf and as part of K, as described above. Because all factors are known, except V2, V2 is solved for. V2 is used as the calculated average plunger velocity (adjusted). After the controller calculates the calculated average plunger velocity in step 116, the controller 40 proceeds to step 118.

At step 118, the controller 40 determines if either V2 is above the high velocity limit or V2 is below the low velocity limit, if so, the controller 40 proceeds to step 120, otherwise, the controller 40 will proceed to step 122. The operator sets the high velocity limit at a value that will prevent the plunger 16 from rising so quickly that the plunger 16 causes damage to the well plunger system 10 due to the plunger 16 forcefully impacting against the upper stop 28 of the plunger tube 14. The operator sets the low velocity limit at a value that will prevent the plunger 16 from rising so slowly that the plunger 16 fails to arrive at the top of the plunger tube 14. In this situation the plunger 16 fails to completely lift the slug of fluids above it out of the plunger tubing 14, which often results in the well becoming filled with fluids to a point at which the production of gas ceases. If the controller 40 proceeded to step 120, then the controller 40 will keep the valve 34 closed regardless of the expiration of the close interval. From step 120, the controller 40 proceeds back to step 112, described above.

Figure 2C:
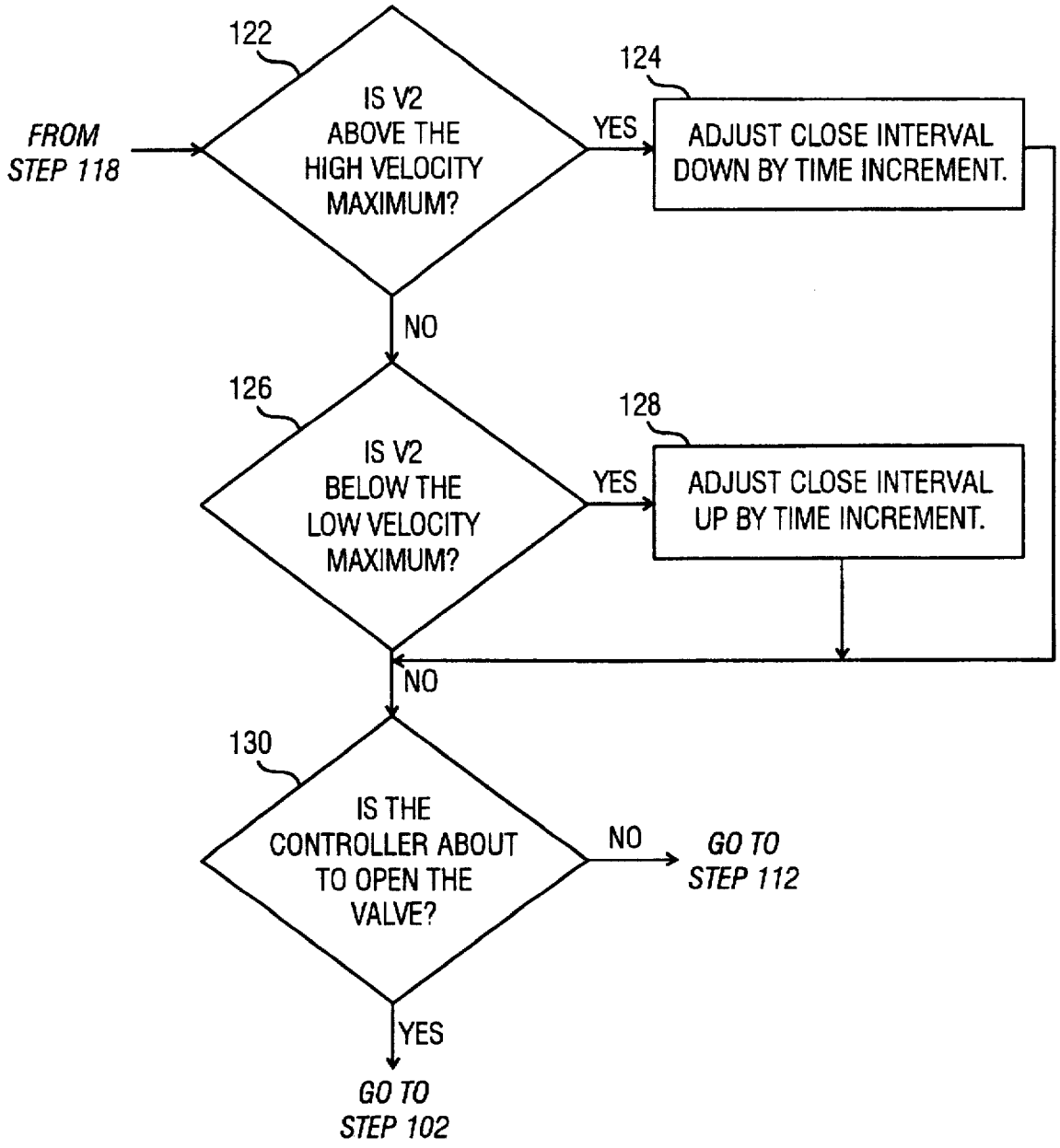
FIG. 2C is flow chart of a portion of the method for controlling a well plunger system embodying the present invention illustrating some of the steps taken by controller to adjust the close interval of the plunger cycle according to the present invention.

If V2 is between the high velocity limit and the low velocity limit at step 118, then the controller 40 proceeds to step 122. At step 122, in FIG. 2C, if V2 is above the high velocity maximum, go to step 124, otherwise, go to step 126. The high velocity maximum defines the upper boundary of the desirable range of plunger speeds. Typically, the high velocity maximum is set to 1000 feet per minute. If the controller 40 proceeded to step 124, then the controller 40 will decrease the duration of the close interval by an operator specified time increment. A typical time increment is 10 minutes. In the preferred embodiment, the close interval cannot be decreased, or increased, by more than one time increment. Thus, if the controller 40 reaches step 124 a second time and the close interval is decreased from its original valve calculated for the current close interval, then no further adjustment to the close interval is made. However, if the close interval has not been decreased, or has been increased, the close interval can be decreased at step 124.

After the controller 40 performs step 124, the controller 40 proceeds to step 130. If V2 was not above the high velocity maximum at step 122, the controller 40 proceeds to step 126.

At step 126, if V2 is below the low velocity minimum, go to step 128, otherwise, go to step 130. The low velocity minimum defines the lower boundary of the desirable range of plunger speeds. Typically, the low velocity minimum is set to 500 feet per minute. If the controller 40 proceeded to step 128, then the controller 40 will increase the duration of the close interval by the operator specified time increment, e.g., a typical time increment is 10 minutes. If the controller 40 reaches step 128 a second time and the close interval is increased from its original valve calculated for the current close interval, then no further adjustment to the close interval is made. However, if the close interval has not been increased, or has been decreased, the close interval can be increased at step 128. After the controller 40 performs step 128, the controller 40 proceeds to step 130. At step 130, in FIG. 2C, the controller 40 determines if the controller 40 is about to open the valve 34, as described in U.S. Pat. No. 5,146,991 (Ser. No. 684,162), incorporated by reference, if so, go to step 102 in FIG. 2A, if not, go to step 112, in FIG. 2B.

What is claimed is:

1. A method of controlling a well plunger system, said well plunger system including a plunger tube positioned within a well, a movable plunger positioned within said plunger tube, a tubing line connected to said plunger tube, said tubing line coupled to an inlet side of a valve, said valve having an outlet side connected to a sales line, said sales line connected to a gas distribution system, a sales line pressure sensor connected to said sales line, said pressure sensor capable of sensing the pressure within said sales line, a casing pressure sensor connected to casing, said casing pressure sensor capable of sensing the pressure within said casing, a plunger sensor connected near the top of said plunger tube, said plunger sensor capable of detecting the presence of said plunger proximate to said plunger sensor, and a controller capable of operating said valve, comprising the steps of:

transmitting an arrival signal indicating the presence of the plunger near the top of the plunger tube from said plunger sensor to said controller;

calculating with the controller a calculated average plunger speed from said arrival signal;

transmitting a sales line pressure signal from said sales line pressure sensor to said controller;

adjusting said calculated average plunger speed by an amount proportional to changes in the sales line pressure; and adjusting an amount of time said valve is closed by an amount proportional to said calculated average plunger speed.

2. The method of controlling a well plunger system of claim 1, wherein said step of adjusting an amount of time said valve is closed further comprises increasing said amount of time said valve is closed if said sales line pressure increases.

3. The method of controlling a well plunger system of claim 1, wherein said step of adjusting an amount of time said valve is closed further comprises decreasing said amount of time said valve is closed if said sales line pressure decreases.

4. The method of controlling a well plunger system of claim 1, further comprising;

transmitting a casing pressure signal from said casing pressure sensor to said controller; and adjusting said calculated average plunger speed by an amount proportional to changes in the casing pressure and said sales line pressure.

5. A well plunger system coupling a well to a gas distribution system having a sales line, comprising:

a plunger tube positioned within the well;

a movable plunger positioned within said plunger tube;

a valve having an inlet side and an outlet side, said outlet side connected to the sales line;

a tubing line connected between said plunger tube and said inlet side of said valve;

a sales line pressure sensor connected to said to the sales line, said sales line pressure sensor capable of sensing the pressure within the sales line and generating a sales line pressure signal; and a controller electrically coupled to said sales line pressure sensor to receive said sales line pressure signal, said controller adjusting an amount of time said valve is closed by an amount proportional to a change in said sales line pressure.

6. The well plunger system of claim 5, further comprising a plunger sensor connected to said plunger tube for producing an arrival signal indicating the presence of the plunger near the top of the plunger tube from said plunger sensor to said controller.

7. The well plunger system of claim 6, further comprising a casing, said casing positioned radially around said plunger tubing, and a casing pressure sensor connected to said casing for producing an casing pressure signal, said casing pressure sensor transmitting said casing pressure signal to said controller.

8. The well plunger system of claim 7, wherein said controller calculates a calculated average plunger velocity and adjusts said calculated average plunger velocity higher during a present close interval, if pressure in said sales line is lower than it was during a previous close interval.

9. The well plunger system of claim 7, wherein said controller calculates a calculated average plunger velocity and adjusts said calculated average plunger velocity lower during a present close interval, if pressure in said sales line is higher than it was during a previous close interval.

10. Apparatus for controlling a well plunger system including a plunger tube positioned within a well, a movable plunger positioned within said plunger tube, a tubing line connected to said plunger tube, said tubing line coupled to an inlet side of a valve, said valve having an outlet side connected to a sales line, said sales line connected to a gas distribution system, a sales line pressure sensor connected to said sales line, said pressure sensor capable of sensing the pressure within said sales line, a casing pressure sensor connected to casing, said casing pressure sensor capable of sensing the pressure within said casing, a plunger sensor connected near the top of said plunger tube, said plunger sensor capable of detecting the presence of said plunger proximate to said plunger sensor, and a controller capable of operating said valve, comprising:

a controller, said controller receiving a signal from the plunger sensor and calculating a calculated average plunger velocity, said controller receiving a signal from said casing sensor and calculating an amount of fluid moved by the plunger per plunger cycle, said controller receiving a sales line pressure signal during a close interval in the plunger cycle and adjusting said calculated average plunger speed by an amount proportional to said sales line pressure, said controller decreasing said close interval if said calculated average plunger speed is greater than a high velocity maximum, and said controller increasing said close interval if said calculated average plunger speed is less than a low velocity minimum.

* * * * *

UNITED STATES PATENT AND TRADEMARK OFFICE

CERTIFICATE OF CORRECTION

PATENT NO. : 5,785,123

DATED : July 28, 1998

INVENTOR(S) : James F. Lea, Jr.

It is certified that error appears in the above-identified patent and that said Letters Patent is hereby corrected as shown below:

| Col. | Line | |
|---|---|---|
| 5 | 32 | "The casing, 12 is . . ."<br><br>should read:<br>"The casing 12 is . . ." |
| 5 | 48 | "Opening, and closing . . ."<br><br>should read:<br>"Opening and closing . . ." |
| 8 | 22 | "("VI" )"<br><br>should read:<br>"("Vl")" |

Signed and Sealed this

Twenty-first Day of September, 1999

*Attest:*

Q. TODD DICKINSON

*Attesting Officer*

*Acting Commissioner of Patents and Trademarks*